US012297034B2

(12) United States Patent
Polloni et al.

(10) Patent No.: US 12,297,034 B2
(45) Date of Patent: May 13, 2025

(54) PACKAGE FOR SMOKING ARTICLES

(71) Applicant: G.D SOCIETA' PER AZIONI, Bologna (IT)

(72) Inventors: Roberto Polloni, Bologna (IT); Luca Paradiso, Bologna (IT); Lorena D'Alfonso, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 71 days.

(21) Appl. No.: 17/968,670

(22) Filed: Oct. 18, 2022

(65) Prior Publication Data

US 2023/0117199 A1 Apr. 20, 2023

(30) Foreign Application Priority Data

Oct. 18, 2021 (IT) ..... 102021000026570

(51) Int. Cl.
*B65D 85/10* (2006.01)
*A24F 40/10* (2020.01)
*A24F 40/20* (2020.01)

(52) U.S. Cl.
CPC ..... *B65D 85/1063* (2013.01); *A24F 40/10* (2020.01); *A24F 40/20* (2020.01)

(58) Field of Classification Search
CPC ..... B65D 85/1063; B65D 85/109; B65D 85/1072; B65D 85/1081; A24F 40/20; A24F 40/10
USPC ..... 206/223, 261, 271, 273, 745, 242
See application file for complete search history.

(56) References Cited

U.S. PATENT DOCUMENTS 5,992,621 A * 11/1999 Grant ..... B65D 85/1081 206/257
2009/0045082 A1* 2/2009 Malboze ..... B65D 5/48 206/223
2010/0170941 A1* 7/2010 Mitra-Shah ..... B65D 5/4204 229/162.1

(Continued)

FOREIGN PATENT DOCUMENTS

EP 2253233 A1 * 11/2010 ..... A24B 15/167
EP 3326936 A1 5/2018
GB 102586 * 12/1916

(Continued)

OTHER PUBLICATIONS

Italian Search Report and Opinion for Corresponding Italian Patent Application No. 202100026570 dated Mar. 25, 2022.

*Primary Examiner* — Rafael A Ortiz
(74) *Attorney, Agent, or Firm* — MARSHALL, GERSTEIN & BORUN LLP

(57) ABSTRACT

The invention relates to a package of smoking articles comprising: a front wall; a rear wall; a bottom; two side walls; and at least a first support wall, which has a first group of seats for receiving, each one, a smoking article and is arranged in proximity to the front wall so as to be transversal to the front wall and to the rear wall. Each side wall has: a first portion proximal to the front wall; a second portion proximal to the rear wall; and a folding line arranged between the first portion and the second portion so as to allow the folding of the first portion on the second portion, or vice versa, causing the mutual distancing and approach of the front wall and of the rear wall.

14 Claims, 4 Drawing Sheets

(56) References Cited

U.S. PATENT DOCUMENTS

| | | | | |
|---|---|---|---|---|
| 2016/0050976 | A1* | 2/2016 | Righetti | A24B 15/167<br>206/265 |

FOREIGN PATENT DOCUMENTS

| | | | | |
|---|---|---|---|---|
| GB | 102586 | A | 12/1916 | |
| WO | WO-2012119607 | A1 * | 9/2012 | B65D 85/1045 |
| WO | WO-2019145682 | A1 * | 8/2019 | B65D 75/5838 |

* cited by examiner

PACKAGE FOR SMOKING ARTICLES

This application claims priority from Italian patent application no. 102021000026570 filed on Oct. 18, 2021, the entire disclosure of which is incorporated herein by reference.

TECHNICAL FIELD

The present invention relates to a package of smoking articles.

It should be noted that the expression "smoking articles" means articles of any kind relating to said field, for example traditional cigarettes or "heat not burn" (HNB) articles which only provide for heating and not combustion of the article itself. The expression "smoking articles" also refers to cartridges containing liquid or powder substances intended for use in electronic cigarettes or other devices that allow them to be heated in order to generate aerosols.

PRIOR ART

The smoking articles are generally arranged inside the package side by side, in close contact with one another. This condition can considerably complicate the extraction thereof from the package, especially if it is the first article to be extracted and/or if the dimensions of the articles are limited. In cigarettes or similar articles, for example, the extraction of the same from the package often results in the damage thereof, because they are crushed by the fingers of the user in order to extract them.

In the case of cartridges containing liquid or powder substances, which are substantially more rigid than cigarettes, extraction in said conditions can be almost impossible: often the user is forced to extract them all and then has to put them back in the package, except for the one to be used. Furthermore, the fact of having to touch said cartridges with the fingers is not hygienic and often preferably avoidable by the user. Furthermore, usually solutions that aim towards the "singularization" of the smoking articles often result in significant dimensions due to the precautions necessary for said purpose.

DESCRIPTION OF THE INVENTION

The object of the present invention is to overcome the aforementioned drawbacks.

Said object is achieved by proposing a package of smoking articles according to the attached claims.

Advantageously, the package proposed with the invention allows to easily extract smoking articles of any type, while maintaining small dimensions.

BRIEF DESCRIPTION OF THE DRAWINGS

Further advantages will be made clearer in the following description, with the aid of the attached drawings, wherein.

PREFERRED EMBODIMENTS OF THE INVENTION

Figure 2:
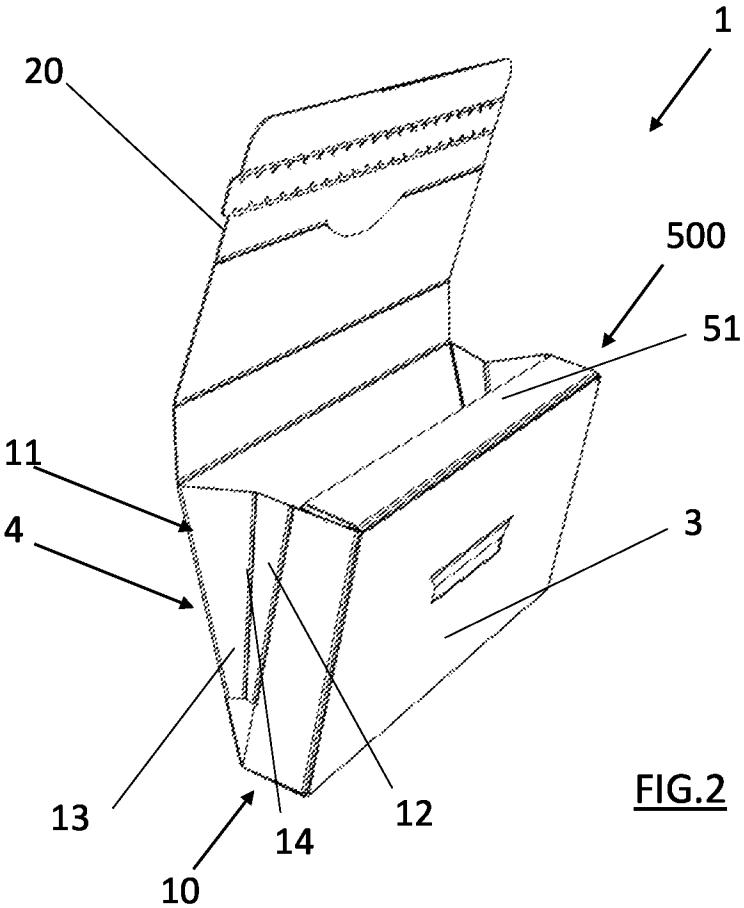
FIG. 2 is a perspective view of the package of FIG. 1, in a second configuration.
Figure 1:
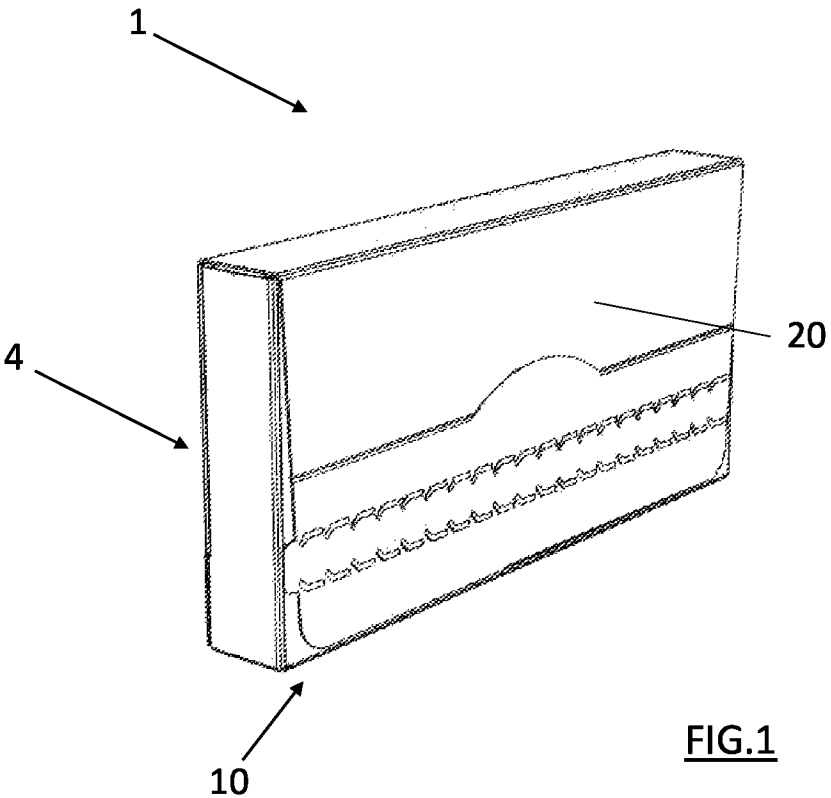
FIG. 1 is a perspective view of a package according to the present invention, according to a first embodiment, in a first configuration.

With reference to the attached FIGS. 1-4, the reference number 1 denotes a package of smoking articles 2 according to the present invention.

It should be noted that the expression "smoking articles" means articles of any kind relating to said field, for example traditional cigarettes or "heat not burn" (HNB) articles which only provide for heating and not combustion of the article itself. The expression "smoking articles" also refers to cartridges containing liquid or powder substances intended for use in electronic cigarettes or other devices that allow them to be heated to generate aerosols.

The package 1 of smoking articles 2 according to the invention comprises: a front wall 3; a rear wall 4, opposite the front wall 3; a bottom 10, connected to the front wall 3 and to the rear wall 4; and two side walls 11, opposite one another and both connected to the front wall 3, to the rear wall 4 and to the bottom 10.

The package 1 further comprises at least a first support wall 5 (shown in FIG. 7 in an "extended" configuration) comprising a first group of seats 50 for receiving, each one, a smoking article 2; the first support wall 5 is preferably arranged near the front wall 3 (see for example FIG. 1) to be transversal (preferably perpendicular) to the front wall 3 and to the rear wall 4. According to an alternative not illustrated, the first support wall 5 is arranged near the rear wall 4.

Figure 4:
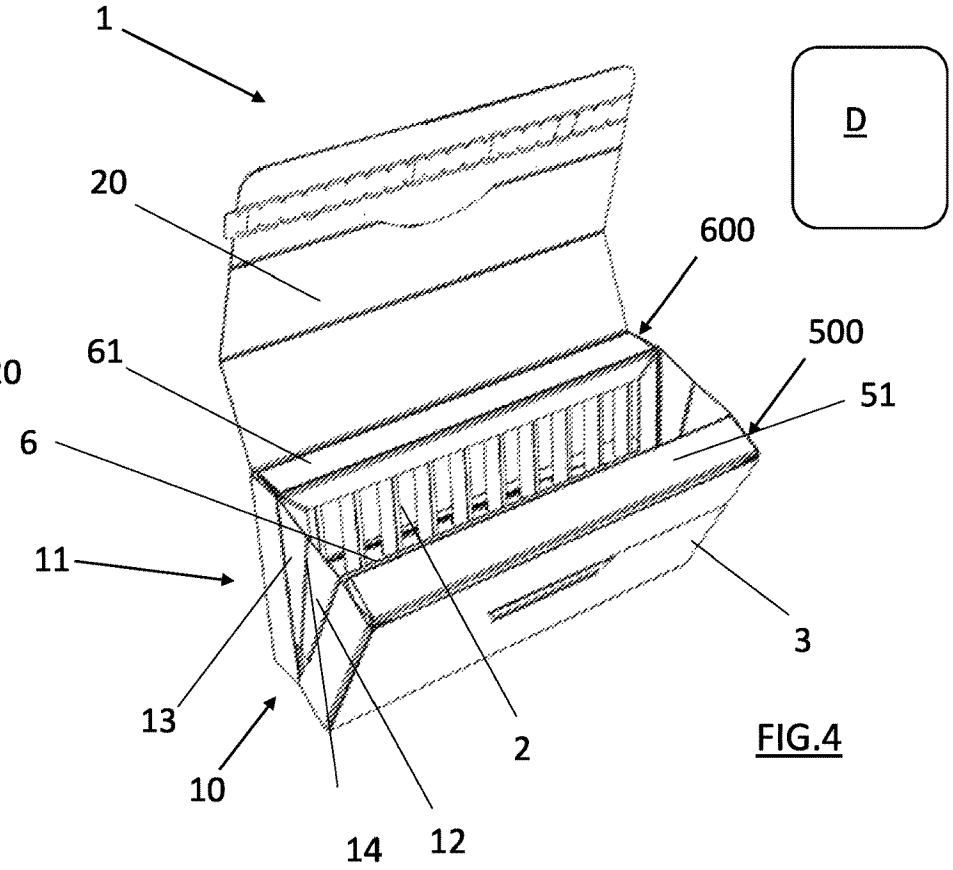
FIG. 4 is a perspective view of the package of FIG. 3, in a second configuration.
Figure 3:
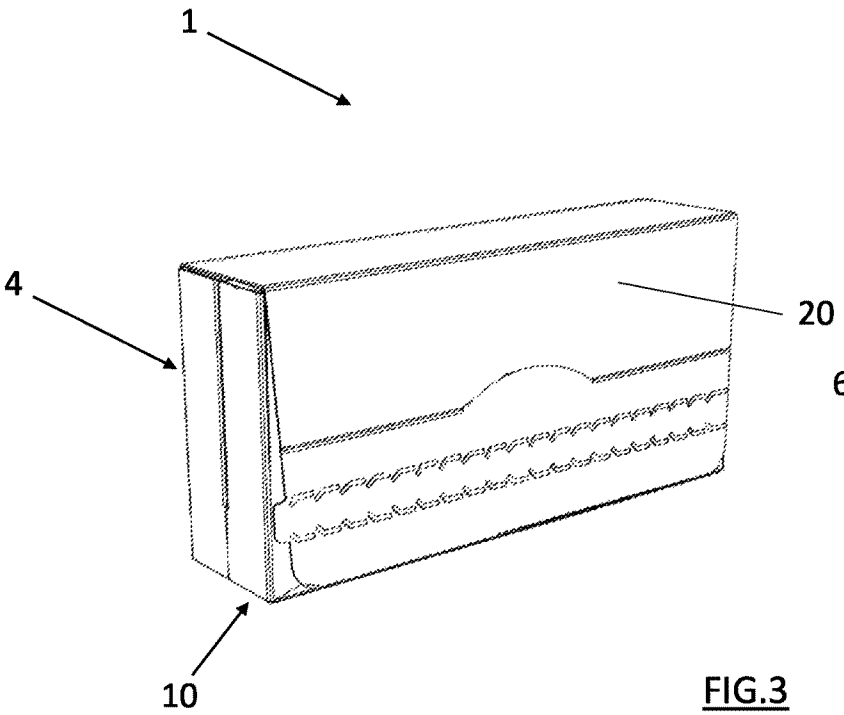
FIG. 3 is a perspective view of a package according to the present invention, according to a second embodiment, in a first configuration.
Figure 8:
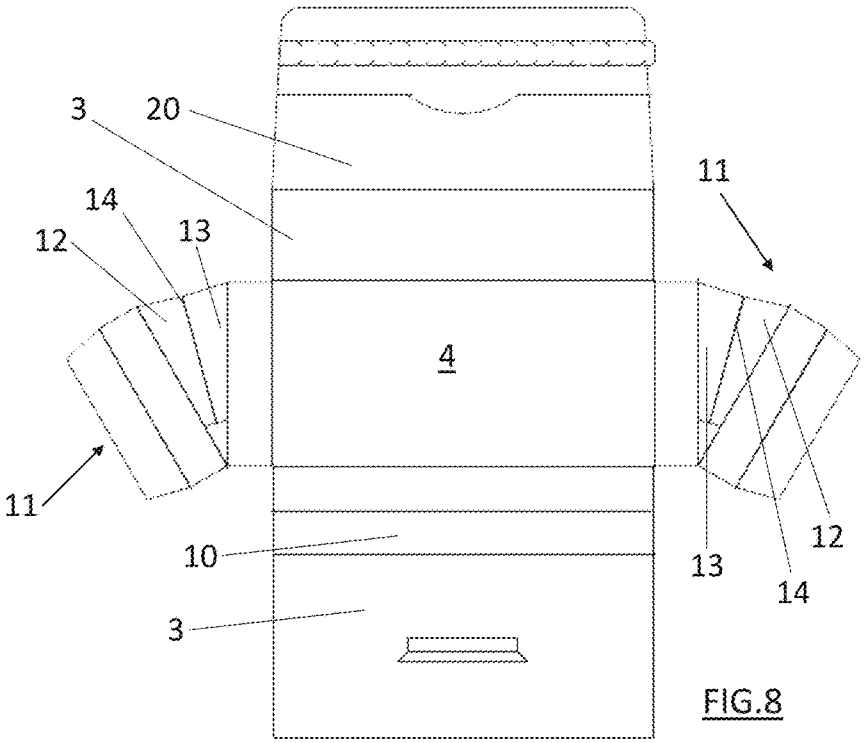
FIG. 7 and FIG. 8 are two plan views of two parts of the package according to the invention, in an extended configuration.

Furthermore, each side wall 11 comprises: a first portion 12, proximal to the front wall 3; a second portion 13, proximal to the rear wall 4; a folding line 14, arranged between the first portion 12 and the second portion 13 so as to allow the folding of the first portion 12 on the second portion 13, or vice versa, causing the mutual distancing and approach of the front wall 3 and the rear wall 4 (see FIGS. 2, 4 and 8 in detail).

Advantageously, the package 1 proposed with the invention, thanks to the folding line 14, arranged between the first portion 12 and the second portion 13, allows the front wall 3 and the rear wall 4 to be spaced from one another in order to easily extract smoking articles 2 of any type, while maintaining small dimensions.

With specific reference to the attached FIGS. 1-4, the package 1 comprises, furthermore, a closing element 20 connected to the rear wall 4 and connectable to the front wall 3 by means of a respective flap to close the package 1 (FIGS. 1, 3) and to allow the opening of the same (FIGS. 2, 4).

With reference to the attached figures, the first group of seats 50 is shaped so that the smoking articles 2 are arranged in the seats with their respective longitudinal axis substantially perpendicular to the first support wall 5.

Preferably, the package 1 further comprises a second support wall 6 (similar to the first support wall 5 of FIG. 7) comprising, in turn, a second group of seats 60 (partially shown in FIG. 6) for receiving, each one, a smoking article 2; the second support wall 6 is preferably arranged in proximity to the rear wall 4 to be transversal to the front wall 3 and to the rear wall 4 (see again the embodiment of FIG. 4). According to an alternative not illustrated, the first support wall 5 is arranged in proximity to the front wall 3.

Advantageously, the first group of seats 50 is obtained in the first support wall 5 and/or the second group of seats 60 is obtained in the second support wall 6. In other words, the first support wall 5 is provided with the first group of seats 50 and/or the second support wall 6 is provided with the second group of seats 60.

Advantageously, each seat of the first group of seats 50 and/or of the second group of seats 60 (if present) is defined by a recess or through opening made in the respective support wall 5 or 6. Each seat of the first group of seats 50 and/or of the second group of seats 60 (if present) has a shape such as to define a housing for a respective smoking article 2.

Advantageously, said specification allows a greater number of smoking articles 2 to be housed in the package 1.

With reference to the attached figures, the second group of seats 60 is shaped so that the smoking articles 2 are arranged in the seats with their respective longitudinal axis substantially perpendicular to the second support wall 6.

Figure 6:
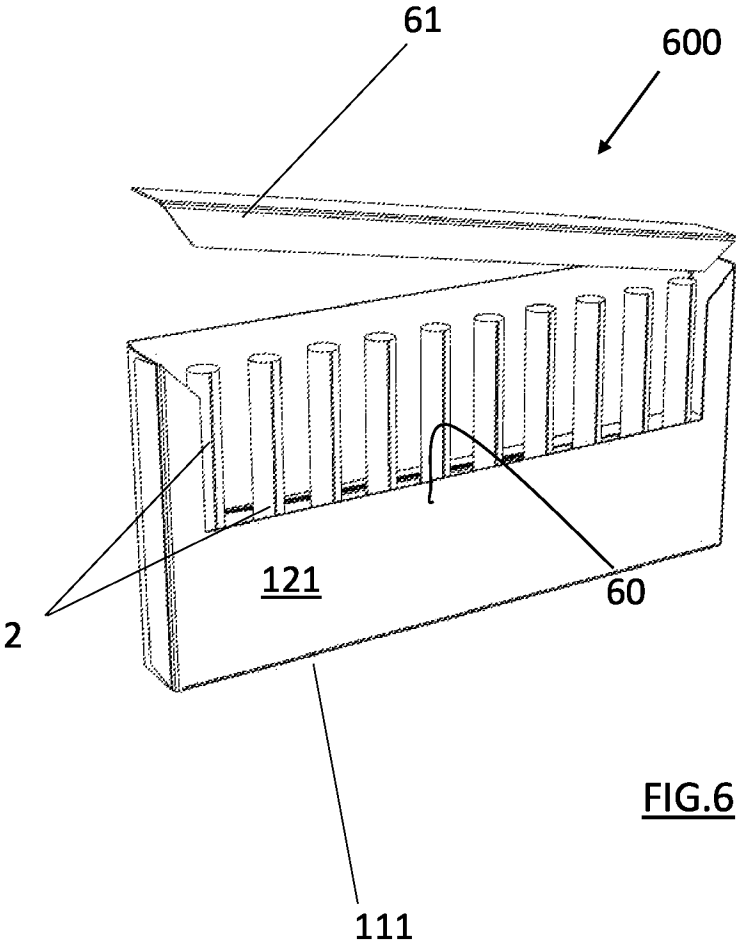
FIG. 5 and FIG. 6 are two perspective views of two elements of the package according to the invention, in two different operating configurations.
Figure 5:
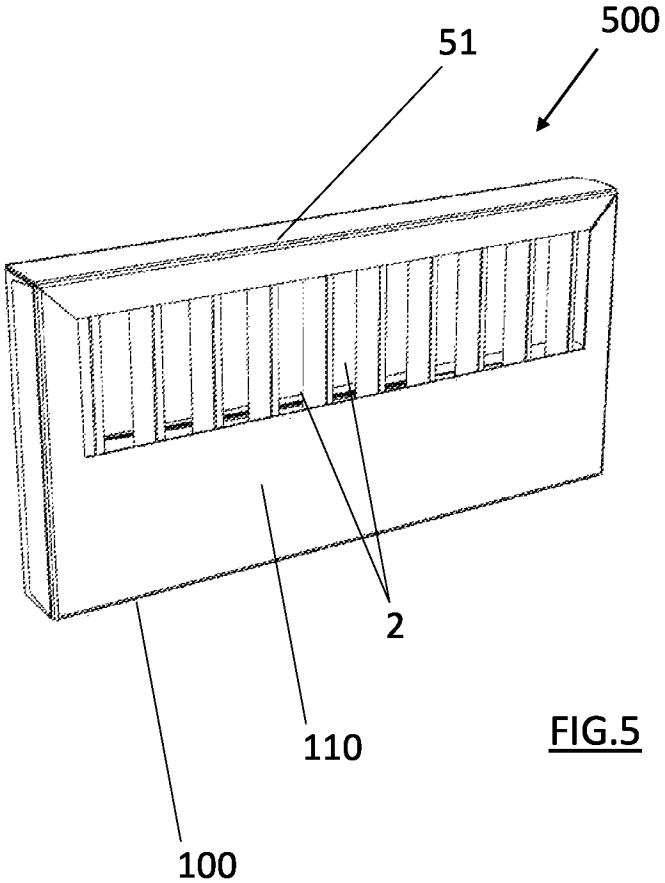

Preferably, the first group of seats 50 and/or the second group of seats 60 is arranged according to a row (for example a single row of mutually aligned seats, as shown for example in FIGS. 5 and 6).

According to the illustrated preferred embodiment, the package 1 further comprises a first box-like compartment 500 (formed for example with cellulose-based sheet material) comprising a bottom 100 and side walls 110 (see FIGS. 5 and 7 in detail) to define a first compartment; the first box-like compartment 500 (illustrated per se in FIGS. 5 and 6, and according to an extended configuration in FIG. 7) comprises the first support wall 5 which is arranged within the first compartment.

The presence of the first box-like compartment 500 allows to contain and protect the smoking articles 2.

The first box-like compartment 500 can comprise a covering portion 51 (see FIGS. 5 and 6) which can be removed to access the smoking articles 2 upon the first opening. The covering portion has a physical and hygienic protection function of the smoking articles 2.

Figure 7:
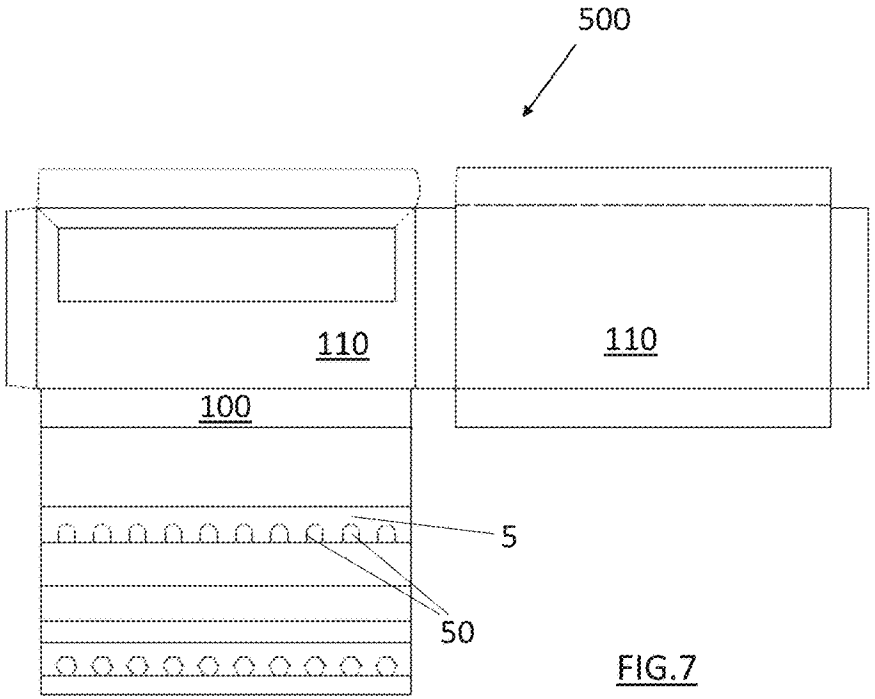

Preferably, the first box-like compartment 500 is made in a single body, that is, the first box-like compartment 500 comprising the first support wall 5 is obtained from a single sheet of material, suitably folded (see FIG. 7).

According to the illustrated preferred embodiment, the package 1 further comprises a second box-like compartment 600 comprising a bottom 111 and side walls 121 (see FIG. 6) to define a second compartment; the second box-like compartment 600 comprising the second support wall 6 arranged within the second compartment.

The presence of the second box-like compartment 600 allows to contain and protect the smoking articles 2.

The second box-like compartment 600 can comprise a covering portion 61 which can be removed to access the smoking articles 2 upon first opening. The covering portion has a physical and hygienic protection function of the smoking articles 2.

Preferably, the second box-like compartment 600 is made in a single body, that is, the second box-like compartment 600 comprising the second support wall 6 is obtained from a single sheet of material, suitably folded.

According to the preferred embodiment, the smoking articles 2 can be used in the device D for the electric heating of the smoking articles 2 themselves provided with a seat for receiving a smoking article 2. Preferably the first portion 12 and the second portion 13 of each side wall 11 of the package 1 are configured so as to cause the mutual distancing of the front wall 3 and of the rear wall 4 so that the device D can be inserted between the same to receive a smoking article 2 in the aforementioned seat.

Advantageously, this configuration allows a smoking article 2 to be hooked to the device D without touching it by hand, thus ensuring maximum hygiene for the user.

The invention further relates to a kit comprising a package 1 according to the embodiment just described and a device D for electrically heating the smoking article 2, provided with a seat for receiving a smoking article 2 (see FIG. 4, where the device D has been schematized).

The invention claimed is:

1. A package (1) for containing smoking articles (2) comprising:

a front wall (3);

a rear wall (4) opposite the front wall (3);

a bottom (10) connected to the front wall (3) and to the rear wall (4);

two side walls (11) opposite one another and both connected to the front wall (3), to the rear wall (4) and to the bottom (10); and at least a first support wall (5) comprising a first group of seats (50) for receiving, each one, a smoking article (2) and arranged in proximity to the front wall (3) so as to be transversal to the front wall (3) and to the rear wall (4);

wherein each side wall (11) comprises: a first portion (12), proximal to the front wall (3); a second portion (13), proximal to the rear wall (4); a folding line (14), arranged between the first portion (12) and the second portion (13) so as to allow the folding of the first portion (12) on the second portion (13), or vice versa, causing the mutual distancing and approach of the front wall (3) and of the rear wall (4), and wherein the first portion (12) and the second portion (13) of each side wall (11) of the package (1) are configured to cause the mutual distancing of the front wall (3) and of the rear wall (4) so that when an electric heating device is used with the package, the electric heating device (D) is be inserted between the front wall and rear wall, the electric heating device (D) having a seat for receiving a smoking article (2), wherein the electric heating device (D) is configured to electrically heat the smoking article (2) when the smoking article (2) is arranged in the seat of the electric heating device (D).

2. The package (1) according to claim 1, further comprising a second support wall (6) comprising a second group of seats (60) for receiving, each one, a smoking article (2); the second support wall (6) is arranged in proximity to the rear wall (4) so as to be transversal to the front wall (3) and to the rear wall (4).

3. The package (1) according to claim 2, wherein the first group of seats (50) and/or the second group of seats (60) is arranged in a row.

4. The package (1) according to claim 1 and further comprising a first box-like compartment (500) comprising a bottom (100) and side walls (110) to define a first compartment; the first box-like compartment (500) comprising the first support wall (5) arranged within the first compartment.

5. The package (1) according to claim 4, wherein the first box-like compartment (500) is made in a single body.

6. The package (1) according to claim 2 and further comprising a second box-like compartment (600) comprising a bottom (111) and side walls (121) to define a second compartment; the second box-like compartment (600) comprising the second support wall (6) arranged within the second compartment.

7. The package (1) according to claim 6, wherein the second box-like compartment (600) is made in a single body.

8. The package (1) according to claim 1, wherein the package is configured to house smoking articles (2) that are cartridges containing liquid or powder substances.

9. The package (1) according to claim 1, wherein the first group of seats (50) is obtained in the first support wall (5).

10. The package (1) according to claim 1, wherein each seat of the first group of seats (50) is defined by a recess or through opening made in the first support wall (5).

11. The package (1) according to claim 2, wherein the second group of seats (60) is obtained in the second support wall (6).

12. The package (1) according to claim 2, wherein each seat of the second group of seats (60) is defined by a recess or through opening made in the second support wall (6).

13. The package (1) according to claim 1, wherein the first portion (12) is directly connected to the second portion (13) of each side wall (11) via the folding line (14).

14. A kit, comprising:

a package (1) for containing smoking articles, the package (1) comprising:

a front wall (3);

a rear wall (4) opposite the front wall (3);

a bottom (10) connected to the front wall (3) and to the rear wall (4);

two side walls (11) opposite one another and both connected to the front wall (3), to the rear wall (4) and to the bottom (10);

at least a first support wall (5) comprising a first group of seats (50) for receiving, each one, a smoking article (2) and arranged in proximity to the front wall (3) so as to be transversal to the front wall (3) and to the rear wall (4), wherein each side wall (11) comprises: a first portion (12), proximal to the front wall (3); a second portion (13), proximal to the rear wall (4); a folding line (14), arranged between the first portion (12) and the second portion (13) so as to allow the folding of the first portion (12) on the second portion (13), or vice versa, causing the mutual distancing and approach of the front wall (3) and of the rear wall (4); and an electric heating device (D) having a seat for receiving a smoking article (2), wherein when in use with the package electric heating device (D) is inserted between the front and rear walls (3, 4) and configured to electrically heat the smoking article (2) when the smoking article is provided in the seat of the electric heating device (D).

* * * * *